United States Patent [19]

Glorfield et al.

[11] 4,351,141

[45] Sep. 28, 1982

[54] CARTON FILLING SYSTEM

[75] Inventors: Paul H. Glorfield, Caldwell; Spencer L. Bryant, Nampa, both of Id.; Vance L. Kirklin, Hermiston, Oreg.

[73] Assignee: J. R. Simplot Company, Boise, Id.

[21] Appl. No.: 180,971

[22] Filed: Aug. 25, 1980

[51] Int. Cl.[3] ..... B65B 5/10; B65B 1/06; B65B 1/08

[52] U.S. Cl. ..... 53/473; 53/237; 53/248; 141/131

[58] Field of Search ..... 53/446, 237, 238, 437, 53/445, 448, 474, 475, 154, 155, 240, 248; 141/131

[56] References Cited

U.S. PATENT DOCUMENTS

| | | | |
|---|---|---|---|
| Re. 27,405 | 6/1972 | Ehe et al. | 53/238 X |
| 2,617,517 | 11/1952 | Daniels | 53/237 X |
| 3,339,335 | 9/1967 | Bowden | 53/237 X |
| 3,981,394 | 9/1976 | Slathar et al. | 53/154 X |
| 3,994,321 | 11/1976 | Eisenberg | 53/237 X |

*Primary Examiner*—Horace M. Culver

*Attorney, Agent, or Firm*—Fulwider, Patton, Rieber, Lee & Utecht

[57] ABSTRACT

A carton filling system is provided for continuously and substantially uniformly filling a succession of cartons with a product for shipping. The system is uniquely adapted for handling irregular-shaped products, such as frozen parfried potato strips, for filling the cartons to have a maximum bulk density, and thereby maximize the quantity of product which can be contained in the cartons. The system is embodied in apparatus and method for orienting the product prior to and during filling of the cartons.

49 Claims, 9 Drawing Figures

CARTON FILLING SYSTEM

BACKGROUND OF THE INVENTION

This invention relates to apparatus and method for filling a succession of cartons with a product for shipment. More specifically, this invention relates to an improved system for filling cartons with an irregular-shaped product such as potato strips wherein the quantity of product placed into each carton is maximized.

Automated carton filling systems in general are well known in the art. For example, in the foods industry, it is well known to process a particular food item in bulk and then to convey the processed item to an appropriate packaging line for automated package filling. Of course, it is highly desirable to maximize the quantity of product contained in each individual package, or alternately stated, it is desirable to minimize the size per unit weight of each package so as to make maximum use of shipping and warehousing volumes. However, with some items such as French fried potato strips, green beans, carrot strips, and the like, the product typically has been packaged in a random jackstrawed orientation which does not maximize the bulk density of the product in the package and thereby results in substantial settling of the product during shipment and/or storage. When this settling occurs, some breakage of the product is common resulting in a less desirable product for purchase by the consumer.

These packaging problems are particularly pronounced with frozen parfried potato strips since such strips are relatively fragile, and have a relatively long length compared with their cross sectional dimension. In the prior art, it is well known to package these potato strips by weighing individual quantities of the strips in a hopper and then dumping en masse each weighed quantity into a shipping container such as a bag or carton. However, it has not been feasible to orient the strips in an effort to minimize jackstrawing and to maximize the bulk density of the product in the shipping container. Instead, the container has sometimes been vibrated after filling to settle the product partially for more uniform filling of the container. However, this vibratory settling action does not eliminate the undesired breakage of the product which necessarily results therefrom.

Typical prior art weighing and dumping systems are relatively slow in that a separate weighing and dumping step is required for each individual container to be filled. Accordingly, some attempts have been made to provide continuous fill conveyor systems wherein the product is conveyed along a line for intersection with a conveyed succession of shipping containers to be filled. By appropriate container and product flow control, it is possible to fill the containers with roughly uniform weight measures of the product. However, once again, no attempt has been made to orient the product to maximize the bulk density of the product in the container or to minimize product settling during storage and/or shipment.

The present invention overcomes the problems and disadvantages of the prior art by providing an improved carton filling system for filling shipping cartons with an elongated product such as French fried potato strips to maximize the bulk density of the product in the carton. More specifically, the invention includes means for orienting the product prior to and during filling of the cartons.

SUMMARY OF THE INVENTION

In accordance with the invention, a carton filling system is provided including a carton conveyor for conveying a succession of cartons to be filled along a path for intersection with a product conveyor for conveying an elongated product such as frozen parfried potato strips at a controlled mass flow rate. The product conveyor includes means for orienting the product strips in a common plane, or monolayer, and for substantially aligning the product strips in their direction of travel along the product conveyor and at a relatively small angle with respect to the direction of carton travel along the carton conveyor. The oriented, monolayered product strips are directed to fall from the product conveyor over an angularly downwardly and laterally extending guide ramp into the cartons carried by the carton conveyor.

The product conveyor is supplied with the product strips at a controlled mass flow rate which, according to the width of the product conveyor, allows the product strips to be segregated into the common or monolayered plane. In a preferred embodiment, the product conveyor is inclined downwardly toward the carton conveyor, and includes means for imparting a relatively gentle vibrating action to the product conveyor for causing continuous motion of the product strips along said conveyor. The product conveyor includes a plurality of longitudinally extending risers which cooperate to define longitudinally extending lanes for causing the product strips to spread substantially evenly over the width of the product conveyor and to cause the substantial majority of the product strips to align and orient with their longitudinal dimension corresponding with the direction of travel of the product strips.

The guide ramp is positioned generally in parallel with the carton conveyor generally alongside the cartons, and thus at the relatively small angle with respect to the product conveyor for intersection with the carton conveyor over a substantial portion of the carton conveyor length. The guide ramp extends from the product conveyor angularly downwardly and laterally to a position generally above the adjacent side walls of the cartons and provides a planar surface for guiding the monolayered product strips along a common plane laterally and downwardly into the upwardly open, moving cartons. A vertical deflector wall projects upwardly above the opposite side walls of the cartons to assure that the strips are directed to fall into the cartons with the desired directional orientation. The longitudinal and planar orientation of the product strips enables the strips to deposit within the cartons, with the substantial majority of the strips longitudinally aligned along the direction of carton travel.

For improved orientation of the product, the cartons are sized to have a relatively narrow width, and a relatively elongated longitudinal dimension extending in the direction of carton travel. Because the product conveyor intersects the carton conveyor over a substantial portion of the carton conveyor length, a plurality of the cartons are positioned for receiving the product strips at any one time, whereby each carton is filled relatively slowly as it passes in association with the carton conveyor. The product strips thus fill the cartons to extend generally along the longitudinal carton dimension for maximum carton bulk density when filled. The carton conveyor includes means for imparting a relatively slight vibratory action to the cartons during filling to increase further the bulk density.

In a preferred embodiment, the carton conveyor includes a filling stage in association with the product conveyor for filling the cartons with the strips and an overfill removal stage downstream of the filling stage. A reciprocating assembly is provided for laterally reciprocating the cartons after filling with the product strips to remove from the cartons any product overfill, and thereby assure that each carton is filled completely with a substantially identical weight measure of the product strips. An overfill conveyor can be provided to recycle the removed product to the product conveyor for use in filling subsequent cartons.

Other features and advantages of the present invention will become apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIGS. 3*a* through 3*d* are fragmented vertical sections taken on the lines 3*a*—3*a* through 3*d*—3*d* of FIG. 3;

DETAILED DESCRIPTION OF THE PREFERRED EMBODIMENT

Figures 1, 5:
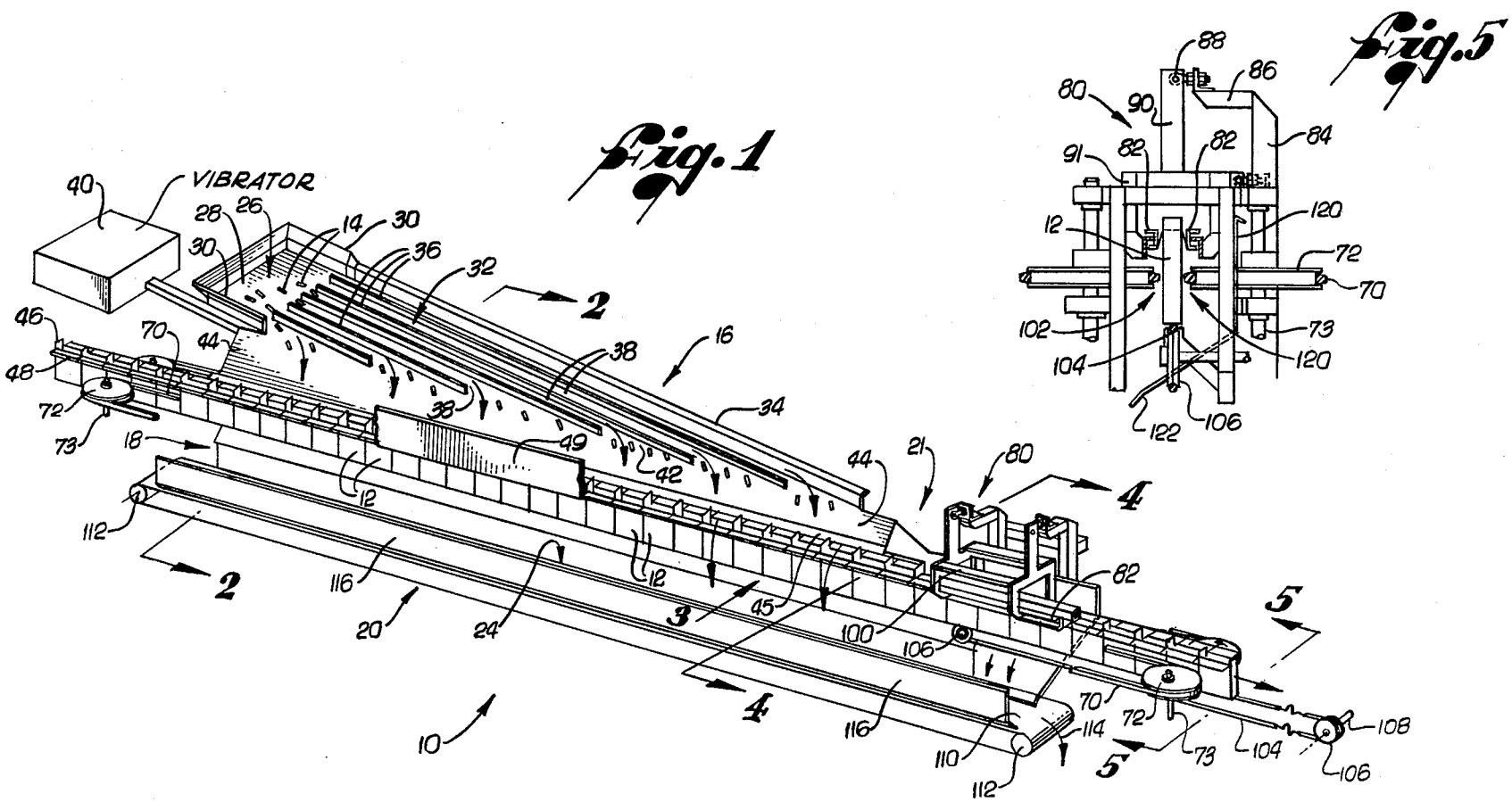
FIG. 1 is a fragmented perspective view illustrating the carton filling system of this invention, with substantial portions removed and broken away to illustrate the continuous filling of a succession of cartons with product strips.
FIG. 5 is an enlarged end view of the carton conveyor taken on the line 5—5 of FIG. 1.

As illustrated in the exemplary drawings, a carton filling system 10 of this invention is provided for the continuous filling of a succession of cartons 12 with a product, such as strips 14, having an elongated strip configuration, such as frozen potato strips. The product strips 14 are continuously conveyed at a controlled flow rate along a product conveyor 16 which intersects a carton conveyor 18 carrying an aligned succession of upwardly open cartons 12. As illustrated, intersection of the product and carton conveyors 16 and 18 occurs over an initial or filling stage 20 of the carton conveyor 18, and this filling stage 20 is followed by an overfill removal stage 22 wherein excess product strips 14 are removed from the cartons 12 and recycled by an overfill conveyor 24 for return to the product conveyor 16.

The design and operation of the carton filling system 10 of this invention comprises a substantial improvement over prior art systems for handling elongated products. The system provides for the orientation of the product strips 14 to prevent jackstrawing of the strips within the cartons 12, and more specifically, to orient the strips in substantial alignment with the longitudinal axis of the cartons 12. In this manner, the bulk density of the product strips 14 contained in each carton 12 is maximized whereby maximum use of the shipping and/or warehousing space required by each carton is obtained. This correspondingly results in an optimization of shipping and warehousing volumes to decrease the overall cost of providing the product strips to the consumer. Moreover, by maximizing product strips bulk density during the filling process, substantial settling of the strips which can frequently result in undesired breakage of the strips is avoided.

The system 10 of this invention has particular application for use in filling cartons 12 with the product strips 14 wherein the strips comprise a relatively long and thin fragile food product such as frozen parfried potato strips. However, it is to be understood that the invention has applicability for use in handling a wide variety of strip-like products such as carrot strips, green beans, and the like, as well as a virtually infinite variety of non-food items. Accordingly, while further reference herein will be made with regard to the product comprising potato strips, no such limitation upon the invention is intended.

In the preparation of potato strips, whole potatoes are washed and then peeled as by a suitable abrasive or chemical solution process. The potatoes are then cut to form elongated strips having the desired dimensions, frequently with a cross section on the order of one-quarter to one-half inch square and a length of about three to six inches. The elongated strips are then blanched and appropriately treated for color control, whereupon the strips are parfried and frozen for packaging and shipment to the consumer.

As illustrated in FIG. 1, the frozen parfried potato strips are fed continuously into an upwardly open hopper portion 26 at the upstream end of the product conveyor 16. The strips 14 are supplied to the hopper portion 26 at a controlled mass flow rate according to the size and rate of travel of the cartons 12 along the carton conveyor 18, as will be discussed herein in more detail. Importantly, apparatus and method for supplying the strips 14 in bulk to the hopper portion 26 at a prescribed mass flow rate are generally conventional in the art, and thus are not shown or described in detail herein.

The hopper portion 26 comprises an upwardly open tray-like structure providing a planar floor 28 of substantial width bounded on three sides by upstanding walls 30 for receiving the potato strips 14. The open side of the hopper portion 26 merges into an elongated chute 32 inclined downwardly both in the longitudinal and lateral directions toward the cartons 12 carried by the carton conveyor 18 and extending longitudinally at a relatively small angle with respect to the direction of travel of the cartons 12. For example, as illustrated in FIG. 1, the chute 32 of the product conveyor 16 is formed to extend from the hopper portion 26 angularly toward the cartons 12 to define an angle of say about 20 degrees between the chute 32 and the direction of carton travel.

The chute 32 comprises an upwardly open trough having a longitudinally extending, upstanding retainer wall 34 positioned along its side opposite the carton conveyor 18. The chute 32 also includes a plurality of upwardly projecting and longitudinally extending risers 36 which divide the chute 32 into a plurality of relatively narrow lanes 38. These lanes 38 and risers 36 serve to separate the product strips 14 for substantially uniformly spreading the strips across the width of the chute. In addition, the lanes 38 function to cause a substantial majority of the strips 14 to align longitudinally to extend in the direction of their movement along the chute. Alternately, if desired, a chute 32 having a corrugated-type cross section can be used to form the lanes 38.

A vibratory shaker assembly 40, illustrated schematically in FIG. 1, is coupled to the product conveyor 16 to impart a continuous longitudinally directed vibration to the hopper portion 26 and the chute 32 including the lanes 38. This vibratory action causes the strips 14 to travel from the hopper portion 26 along the lanes 38 angularly toward the carton conveyor 18. As discussed above, the strips 14 are supplied to the hopper portion 26 at a prescribed flow rate which is chosen specifically to allow the strips 14 within the lanes 38 to orient the product into a monolayer to avoid clumping of the strips and to stage the strips properly for subsequent filling of the cartons 12.

As illustrated in FIG. 1, the chute 32 terminates alongside the carton conveyor 18 in an oblique edge 42 disposed in parallel with the direction of carton travel at a location generally above and laterally to one side of the cartons 12. Because of the substantial width of the chute, this oblique edge 42 extends for a substantial portion of the length of the carton conveyor 18 whereby the intersection of the product and carton conveyors 16 and 18 occurs over a substantial portion of the length of the carton conveyor 18. In this manner, a plurality of cartons are conveyed in association with the product conveyor 16 at any one time, with each carton 12 being in filling communication with the product conveyor 16 for a substantial period of time as the carton 12 travels alongside the oblique edge 42 of the product conveyor 16 to allow for relatively slow filling of each carton with the strips, as will be described herein in more detail.

A guide ramp 44 extends from the oblique edge 42 downwardly and angularly toward the cartons 12 for guiding the strips 14 from the product conveyor 16 into the upwardly open cartons 12. This ramp 44 comprises an elongated length of sheet metal or the like formed to have a smooth and uninterrupted upper surface whereby the strips 14 spill from the lanes 38 over the ramp 44 into the cartons 12. Importantly, this ramp 44 is angularly oriented, such as within the range of about 20 to 60 degrees to the horizontal, to guide the strips in both a vertical and a horizontal direction. In this manner, the strips 14 which reach the top of the ramp 44 as a monolayered, partially directionally oriented mass are caused to maintain their monolayered configuration and substantially their directionally oriented configuration as they fall over the ramp 44 into the cartons 12. The angularly disposed ramp 44 functions to convert the monolayer plane from the plane of the chute 32 first to the plane of the ramp, and then to a monolayered vertical plane for ready filling of the cartons 12. In addition, the ramp 44 assists in the slight angular adjustment of the directional orientation of the strips 14 to cause the strips to correspond more closely with the direction of carton travel. Conveniently, as illustrated, the guide ramp 44 can be formed integrally with the chute 32 and can include a vertically extending guide plate 45 projecting downwardly from the lower edge of the ramp 44 above the adjacent side walls of the cartons to further guide the strips into the cartons.

Figure 2:
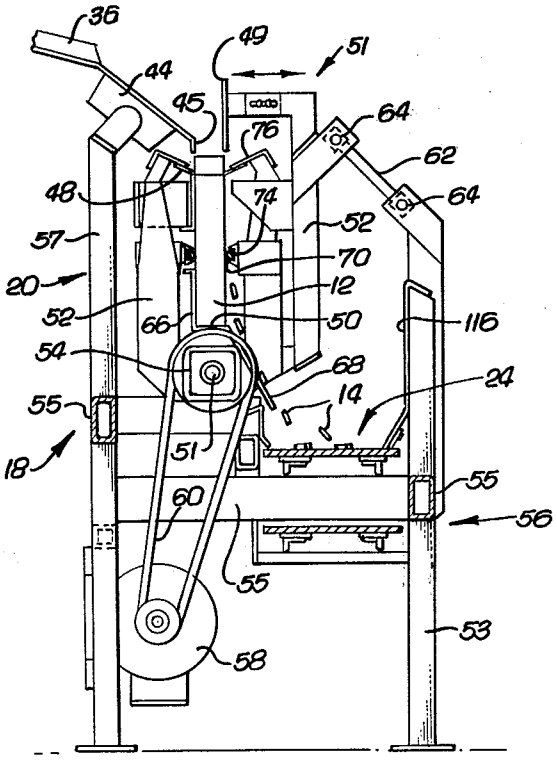
FIG. 2 is an enlarged fragmented vertical section taken on the line 2—2 of FIG. 1 to illustrate the filling stage of a carton conveyor and support structure therefor.

A vertical deflector wall is positioned alongside the cartons 12 to extend in a vertical plane above the side walls of the cartons 12 opposite the guide ramp 44. This deflector wall 49 is shown best in FIG. 2, and functions to assure that the product strips 14 are directed into the cartons 12 with the proper orientation. More specifically, the deflector wall 49 provides a barrier against which any misaligned product strips 14 strike as the strips spill over the angular guide ramp 44. When the misaligned ones of the strips strike the wall 49, they tend to orient themselves to extend generally along the wall in the direction of travel of the adjacent cartons. As the strips further orient, they fall into the underlying cartons 12 with the desired orientation for maximum bulk density of the strips in the cartons. Importantly, as illustrated in FIG. 2, the deflector wall 49 is carried by a horizontally adjustable bracket structure 51 supported by the carton conveyor 18 to allow the wall 49 to be adjusted toward or away from the guide ramp 44 according to the average length of the strips 14 and the desired bulk density of the strips in the cartons 12.

The strips 14 thus fall into the cartons 12 with the substantial majority of the strips aligned in parallel with the direction of carton travel. As illustrated, the cartons 12 are shaped to have a longitudinal dimension corresponding with their direction of travel whereby jackstrawing and random distribution of the strips 14 in the cartons is significantly reduced or avoided. This results in a substantial increase in the bulk density of the product in the cartons, as compared with conventional prior art carton filling techniques, whereby available carton shipping and storage space is maximized and undesired product settling is minimized. Importantly, the cartons 12 are each filled with the strips at a relatively slow filling rate to allow further orientation and alignment of the strips as they fall into the cartons.

The cartons 12 comprise in a preferred embodiment a plurality of identical cartons formed from a relatively lightweight paperboard. As illustrated, the cartons 12 are relatively deep and include a width which is substantially less than their longitudinal dimension. This carton shape has been found to optimize shipping and warehousing volumes when used in conjunction with the orienting carton filling system of this invention. The cartons 12 each further include at its upper extent a pair of relatively short end flaps 46 and a corresponding pair of relatively long side flaps 48 for cooperation to close and seal the cartons, all in a well known-manner.

The cartons 12 are aligned end-to-end for travel in the direction of their longitudinal dimensions along the carton conveyor 18. As shown in FIGS. 1 and 2, this carton conveyor 18 comprises an elongated horizontal plate 50 mounted on a support carriage 52, which is in turn movably mounted on a main conveyor support frame 56 including upright support beams 53 and longitudinal and lateral support beams 55. Conveniently, this main support frame 56 also carries support arms 57, for fixedly positioning the guide ramp 44 with respect to the carton conveyor 18, and the adjustable bracket structure 51 for adjustably supporting the vertical deflector wall 49.

The elongated horizontal plate 50 is formed to extend longitudinally through the carton filling stage 20, and provides a horizontal surface having a width generally corresponding with the width of the cartons for slidably supporting the cartons. On one side of the horizontal plate 50, a guide plate 66 extends upwardly for steadying the cartons 12. On the other side of the plate 50, an overfill deflector plate 68 projects downwardly and laterally toward the overfill conveyor 24 which will be described in more detail.

The cartons 12 are linearly translated continuously along the conveyor 18 at a relatively slow flow rate in sliding contact upon the plate 50 by means of a pair of carton drive belts 70. These belts 70 comprise continuous rubberized Vee-type drive belts each reeved about a pair of pulleys 72 on each side of the cartons. Each pulley 72 is mounted for rotation about a vertical axis defined by an associated shaft 73 which is mounted (not shown) in any suitable manner upon the main conveyor frame 56. On each side of the cartons 12, one of the pulleys 72 is rotatably driven to drive the associated belt 70 at a linear speed corresponding with the desired linear rate of travel of the cartons.

A pair of rails 74 are mounted on the support carriage 52 to extend longitudinally through the filling stage 20. Each rail 74 has a generally U-shaped cross section opening toward the row of cartons 12 in an elevational position generally centrally with respect to the height of the cartons. The carton drive belts 70 on the opposite sides of the cartons are guided within these rails in frictionally gripping contact with the opposite sides of the cartons 12. With this construction, the belts 70 grippingly engage the cartons 12 to drivingly carry the cartons in a continuous succession along the horizontal plate 50 through the filling stage 20. The product strips 14 thus spill from the chute 32 over the guide ramp 44 and into the upwardly open cartons 12 to fill the cartons. As described above, the substantial majority of the strips 14 fall into cartons in alignment with the longitudinal dimensions of the cartons to avoid product jackstrawing and thereby maximize the bulk density of product within each carton. Importantly, the rate of travel of the cartons 12 is chosen to coincide with the mass flow rate of the product and according to the longitudinal length of the guide ramp 44 such that each carton 12 is filled completely and with substantially the same quantity of product as the cartons pass through the filling stage.

The elongated horizontal plate 50 is secured in a suitable manner, as by welding, to the support carriage 52, which comprises an intermediate framework movably supported upon the main conveyor frame 56. More specifically, the support carriage 52 is movably suspended from the main frame 56 by support arms 62 mounted in pivot joints 64. Moreover, the support carriage 52 is connected in a suitable manner to the output shaft 51 of an eccentric or orbital drive unit 54 mounted on the main frame 56. This drive unit 54 is driven by a motor 58 via a drive belt 60, and functions to impart a continuous lateral vibratory action to the support carriage 52. This vibratory action serves to align further the strips 14 falling into and filling the cartons 12 through the filling stage 20 of the carton filling system. Importantly, since the substantial majority of the product strips 14 are already aligned appropriately prior to falling into the cartons 12, and since the rate of filling of the cartons with the strips is relatively slow, this vibratory action has been found to further increase the bulk density of the product strips within the cartons without resulting in significant breakage of the product. Conveniently, the specific construction details of the orbital drive unit 54 and its connection to the support carriage 52 is relatively well known in the art, whereby the drive unit is not shown or described in further detail herein.

As illustrated in FIG. 2, the support carriage 52 includes a pair of angularly disposed flap control members 76 positioned on opposite sides of the cartons 12. These flap control members 76 each comprise elongated sheets of sheet metal or the like for engaging the side flaps 48 of the cartons and for spreading those side flaps 48 to an angle of about 120 degrees with respect to each other. This separation defines a relatively wide-mouthed opening for each carton for reception of the product strips 14 from the chute 32 and moves the side flaps 48 away from interference contact with the ramp 44 or the deflector wall 49.

As the cartons 12 exit the filling stage 20 of the carton conveyor 18 and enter the overfill removal stage 22, as shown in FIG. 1, the side flaps 48 of the cartons are folded downwardly to extend alongside the upper portions of the carton side walls. More specifically, as shown in FIGS. 3 and 3*a* through 3*d*, the downstream ends of the flap control members 76 include downwardly depending ramped legs 78 which engage the side flaps 48 to fold the flaps to a downwardly extending position. This folding of the flaps 48 occurs gradually throughout a transition stage 21 of the carton conveyor, as shown in the sequence depicted by FIGS. 3*a* through 3*d*.

When the carton side flaps 48 reach their downwardly folded positions, the cartons 12 enter the overfill removal stage 22 of the system for removal of strip overfill from the cartons. That is, throughout the filling stage 20, the product strip and carton flow rates are selected to insure complete filling of each carton with the strips. The orientation and monolayering of the strips prior to filling of the cartons, together with the vibratory action imparted to the cartons, serves to insure that each carton is filled at substantially the same bulk density. However, to insure that each carton is completely filled, the product strip flow rate is selected for slight overfilling of the cartons. In this manner, inconsistencies in the flow rates will not result in underfilling of cartons. Importantly, in the overfill removal stage 22, the product overfill is removed from the cartons whereby each carton is filled to the top with the same quantity of the product at substantially the same bulk density.

The overfill removal stage 22 includes an overfill reciprocation or shaker assembly 80 including control arms 82 extending alongside the cartons and movable for laterally reciprocating the cartons 12 to cause any overfilled product to spill laterally from the cartons. More specifically, as shown best in FIGS. 4 and 5, the overfill reciprocator assembly 80 comprises a pair of upright support posts 84 extending upwardly from the main conveyor frame 56 to a position above the cartons 12. These posts 84 include laterally projecting upper beams 86 to which are mounted a pair of pivot joints 88 positioned vertically above the cartons. The pivot joints 88 are pivotally connected respectively to the upper ends of a pair of pivoting legs 90 which project downwardly toward the cartons. As shown, the lower end of each pivoting leg 90 is split to define a pair of leg members 91 terminating on opposite sides of the cartons 12 near the upper ends of the cartons. These leg members 91 in turn are connected to a pair of the longitudinally extending control arms 82.

The two control arms 82 comprise elongated members positioned to engage the row of cartons on opposite sides of the cartons. Each control arm 82 has its upper surface positioned generally to correspond with the upper edge of the adjacent side walls of the cartons, whereby any product overfill in the carton is positioned vertically above the control arm. Moreover, the control arms 82 are spaced from each other for close passage of the cartons 12 therebetween and cooperate with the ramped legs 78 in the transition stage 21 to engage and retain the side flaps 48 of the cartons in the downwardly folded position.

Figure 4:
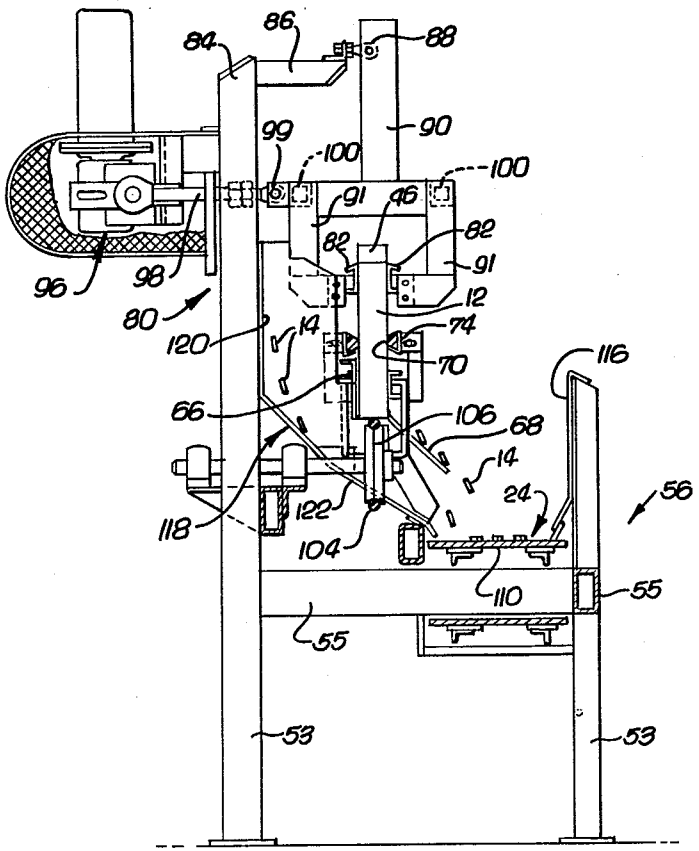
FIG. 4 is an enlarged fragmented vertical section taken on the line 4—4 of FIG. 1 to illustrate the overfill removal stage of the carton conveyor.
Figure 3:
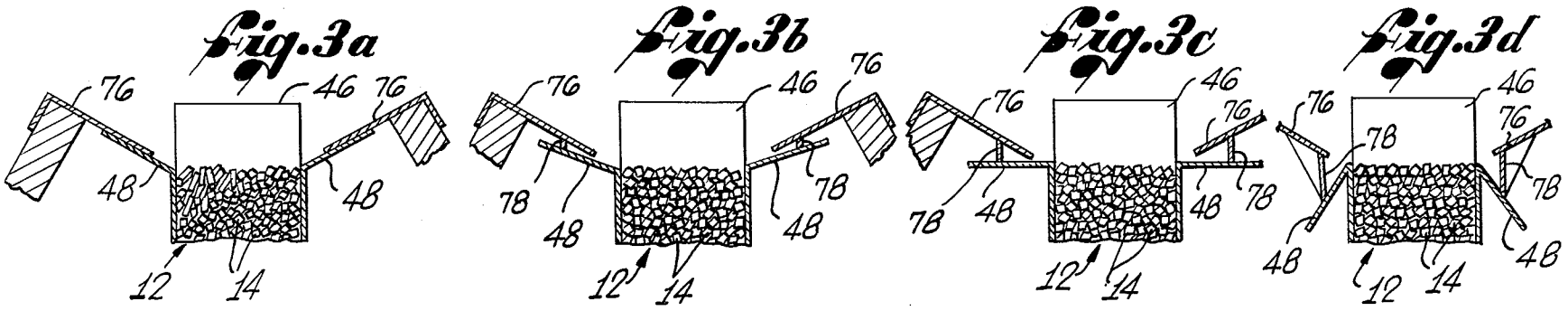
FIG. 3 is an enlarged fragmented elevation view taken on the line 3—3 of FIG. 1 to illustrate transition of the cartons from the filling stage to an overfill removal stage.
Figure 3:
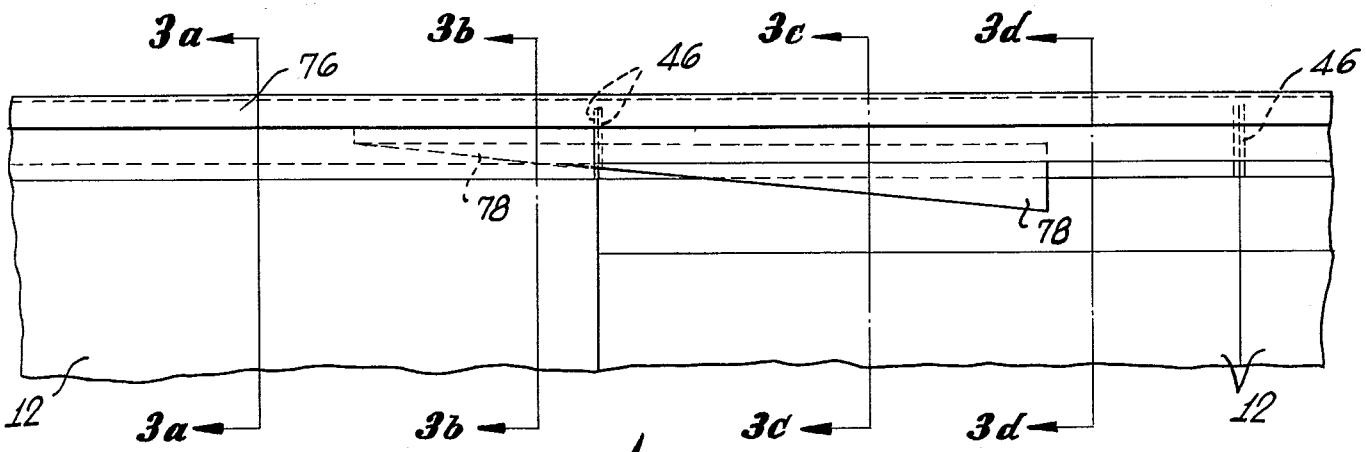

As shown in FIG. 4, the pivoting legs 90 and leg members 91 are reciprocal laterally back and forth about the pivot joints 88, as illustrated by arrow 94. In operation, these legs 90 and leg members 91 are reciprocally driven through this path by a reciprocal drive motor 96 mounted on the main conveyor frame 56. This drive motor 96 includes a drive arm 98 coupled via a pivot joint 99 to a pair of brace members 100 interconnecting the leg members 91 of the reciprocator assembly 80. The drive motor 96 operates to reciprocate the upper portions of the cartons in engagement with the control arms 82 through a relatively short and rapid, vibratory-type stroke to throw any overfilled product from the cartons in either lateral direction.

To facilitate the required lateral shifting of the cartons 12 in the overfill removal stage 22, the drive belts 70 are allowed to move out of engagement with the cartons as the cartons exit the filling stage 22. More specifically, the guide rails 74 on the opposite sides of the cartons terminate generally at the transition stage 21 whereby the belts 70 are allowed to space slightly from the side walls of the cartons, as illustrated at 102 in FIG. 5, to cease driving engagement with the cartons. However, the belts 70 continue to extend alongside the cartons in closely spaced relation therewith throughout the overfill removal stage 22 to define lateral limits of reciprocation for the cartons.

The horizontal plate 50 upon which the cartons 12 slide also terminates at the transition stage 21. At this point, the cartons 12 are guided for further linear transport upon a conveyor pulley belt 104 carried about a pair of pulleys 106, one of which is rotatably driven by a drive shaft 108 coupled to a suitable drive motor (not shown). This conveyor pulley belt 104 thus provides a relatively narrow support surface for supporting and carrying the cartons through the overfill removal stage 22. This provision of the narrow support surface facilitates lateral rocking movement of the cartons in response to the overfill reciprocator assembly 80 as described above. Upon exiting the overfill removal stage 22, the cartons 12 are transported in succession to further appropriate processing equipment for closure of the end and side flaps 46 and 48 and for packing of the cartons in shipping crates or pallets for storage and/or shipment.

The overfill conveyor 24 is provided to catch any product strips 14 which fail to enter the cartons 12 in the filling stage 20 or which are removed from the cartons 12 in the overfill removal stage 22. This conveyor 24 comprises a relatively wide conveyor belt 110 reeved about rollers 112 which are rotatably driven for linearly transporting the belt 110 in any suitable and known manner. The rollers 112 and the belt 110 are carried by the main conveyor support frame 56 to extend alongside the cartons 12 throughout the filling stage 20 and the overfill removal stage 22.

In the product filling stage 20, any product strips 14 failing to enter the cartons 12 are guided downwardly and laterally to the conveyor belt 110 by the overfill deflector plate 68, as shown in FIG. 2. These strips 14 are transported by the belt 110 in the direction of arrow 114 in FIG. 1 for supply to suitable handling equipment (not shown) for returning the strips 14 to the product conveyor 16 for resupply to the cartons 12. Conveniently, as shown in FIG. 2, a retainer wall 116 extends along the side of the conveyor belt 110 opposite the cartons 12 for retaining the spilled product strips on the belt 110.

In the transition stage 21 and the overfill removal stage 22, an overfill catch plate 118 mounted on the main conveyor frame 56, as shown in FIG. 4, serves to guide the product strips to the overfill conveyor 24. This catch plate 118 includes a vertical wall 120 spaced laterally to one side of the cartons opposite the conveyor belt 110, and a lower angled wall 122 extending underneath the cartons angularly downwardly and laterally toward the belt 110. This catch plate 118 in cooperation with the retainer wall 116 serves to guide product strips thrown from the cartons in the overfill removal stage 22 downwardly onto the conveyor belt 110 of the overfill conveyor 24 for recycling.

Thus, the carton filling system 10 of this invention provides apparatus and method for orienting and monolayering the product strips 14 prior to and during the filling of cartons with those strips. The strips are specially oriented to enter the cartons in the orientation required for maximum bulk density of the strips within the cartons. Relatively gentle vibratory action is imparted to the cartons throughout the filling process to further orient the strips to maximize product bulk density and to assure uniform filling of successive cartons. After filling, any product overfill is removed in an overfill removal stage for recycling of the overfilled product for resupply to subsequent cartons.

The apparatus and method of this invention are exemplified by the following working embodiment. Frozen parfried potato strips 14 were supplied at a specified continuous and substantially constant mass flow rate of about four hundred pounds per minute to the hopper portion 26 of the product conveyor 16. The product conveyor 16 was formed to include six of the lanes 38 each approximately six inches in width designed to accommodate potato strips 14 having a length of from about three to six inches and a mean length of about 3–4 inches. The product conveyor 16 was oriented at about 20 degrees to the direction of travel of the cartons 12, whereby each lane 38 communicated with the guide ramp 44 over a length of about three feet, and the total length of the guide ramp 44 through the filling stage 20 was about 18 feet.

The cartons 12 were designed to have a length and a height each about 12.75 inches, and a width of about 2.5 inches for receiving approximately six pounds of the potato strips 14. The cartons 12 were conveyed through the filling stage 20 at a rate of about one foot per second, whereby the product strips 14 spilled over the guide ramp 44 into each carton 12 at a flow rate of about 5–6 ounces per second. Importantly, it was found that faster fill or flow rates in the example tended to decrease the ability of the strips 14 to orient properly and to fall into the cartons with the desired orientation for maximum bulk density.

A variety of modifications and improvements to the carton filling system of this invention are believed to be apparent to one skilled in the art. Accordingly, no limitation on the invention is intended, except as set forth in the appended claims.

What is claimed is:

1. A carton filling system for filling cartons with a plurality of relatively small product strips, comprising:

a carton conveyor for conveying a plurality of upwardly open cartons in succession along a first path;

a product conveyor for conveying a plurality of the product strips along a second path intersecting said first path, said product conveyor including means for orienting the substantial majority of the product strips in a common plane and extending longitudinally generally along said second path; and a guide ramp extending from said product conveyor angularly downwardly and laterally to a position above the cartons, whereby the product strips spill from said product conveyor over said guide ramp and into the cartons as a substantially oriented plurality of strips in a common plane.

2. The carton filling system of claim 1 wherein said product conveyor comprises a trough having an inlet end for receiving continuously a plurality of the product strips, and a discharge end cooperating with said guide ramp, said trough being inclined downwardly from said inlet end to said discharge end, and including vibratory means coupled to said trough for imparting vibratory movement thereto for causing the product strips to move continuously from said inlet end to said discharge end.

3. The carton filling system of claim 2 wherein said trough includes a plurality of longitudinally extending risers spaced laterally from each other to define a plurality of longitudinally extending lanes, said lanes each being sized to cause the substantial majority of the product strips to orient longitudinally in alignment with the longitudinal direction of said lanes.

4. The carton filling system of claim 3 wherein the product strips are continuously supplied to said trough at a mass flow rate whereby the substantial majority of the product strips orient in a common plane to extend in alignment with the longitudinal direction of said lanes.

5. The carton filling system of claim 2 wherein said trough includes a plurality of longitudinally extending risers spaced laterally from each other to define a plurality of longitudinally extending lanes for spreading the products substantially uniformly acorss the width of said trough.

6. The carton filling system of claim 1 wherein said second path and said first path are positioned at a relatively small angle with respect to each other.

7. The carton filling system of claim 6 wherein said product conveyor has a width sufficient for intersection with said first path along a substantial length of said carton conveyor.

8. The carton filling system of claim 6 wherein said relatively small angle is an the order of about 20 degrees.

9. The carton filling system of claim 6 wherein said guide ramp extends generally in parallel with respect to said carton conveyor for a substantial length thereof and at an angle with respect to said product conveyor.

10. The carton filling system of claim 9 wherein said guide ramp is angularly disposed between said product conveyor and said carton conveyor to slightly re-orient the longitudinal orientation of the product strips to extend substantially in parallel with said first path while maintaining the product strips in a common plane.

11. The carton filling system of claim 1 wherein said guide ramp extends from said product conveyor to a position generally above one side of the cartons, and wherein said carton conveyor includes a generally vertical deflector wall positioned generally above the side of the cartons opposite said guide ramp.

12. The carton filling system as set forth in claim 11 wherein said deflector wall is adjustable toward and away from said guide ramp.

13. The carton filling system of claim 1 wherein said carton conveyor includes means for imparting vibratory movement to the cartons simultaneously with filling of the cartons with the product strips.

14. The carton filling system of claim 13 wherein said carton conveyor includes means for conveying said cartons in succession at a relatively slow flow rate sufficient to allow further orientation of the stips during filling of the cartons.

15. The carton filling system of claim 1 wherein said carton conveyor includes a filling stage in association with said guide ramp for filling of the cartons with the product strips, and an overfill removal stage subsequent to said filling stage, said overfill removal stage including means for laterally reciprocating the cartons at a rate and displacement sufficient to throw product strips overfilling the cartons in a lateral direction from the cartons.

16. The carton filling system of claim 15 wherein each of the cartons includes a pair of side flaps and a pair of end flaps at its upper extent for use in closing the carton, said side flaps extending longitudinally in parallel with said first path; and wherein said carton conveyor includes means along said filling stage for positioning each of said side flaps in an angularly upwardly and laterally outwardly projecting position.

17. The carton filling system of claim 16 wherein said carton conveyor further includes a transition stage between said filling stage and said overfill removal stage, said transition stage including means for moving each of said side flaps to a downwardly projecting position alongside the carton.

18. The carton filling system of claim 16 including an overfill conveyor positioned alongside said carton conveyor along said overfill removal stage for collecting product strips thrown from the cartons.

19. The carton filling system of claim 18 wherein said overfill conveyor extends further alongside said transition stage and said filling stage for collecting product strips failing to fall into or remain within the cartons.

20. The carton filling system of claim 1 wherein the relatively small product strips comprise frozen parfried potato strips.

21. The carton filling system for filling cartons with a plurality of potato product strips or the like, comprising:

a carton conveyor for conveying in continuous succession along a first path a plurality of upwardly open cartons having an elongated dimension in alignment with the direction of movement of the cartons;

a product conveyor for conveying a plurality of the strips along a second path disposed at a relatively small angle with respect to said first path, said product conveyor having a substantial width whereby said second path intersects said first path over a substantial portion of the length of said carton conveyor, said product conveyor including means for orienting the substantial majority of the product strips in a common plane spread substantially uniformly across the width of said product conveyor and extending longitudinally generally along said second path; and a guide ramp extending the width of said product conveyor and generally in parallel with said carton conveyor, and defining a downwardly and laterally directed planar surface for guiding the product strips from said product conveyor into the cartons as a substantially oriented plurality of strips in a common plane.

22. The carton filling system of claim 21 wherein said product conveyor comprises a trough having a plurality of longitudinally extending risers spaced laterally from each other to define a plurality of longitudinally extending lanes.

23. The carton filling system of claim 21 wherein said carton conveyor includes means for imparting vibratory movement to the cartons simultaneously with filling of the cartons with the product strips.

24. The carton filling system of claim 21 wherein said guide ramp extends from said product conveyor to a position generally above one side of the cartons, and wherein said carton conveyor includes a generally vertical deflector wall positioned generally above the side of the cartons opposite said guide ramp.

25. The carton filling system of claim 24 wherein said deflector wall is adjustable toward and away from said guide ramp.

26. The carton filling system of claim 21 wherein said carton conveyor includes means for conveying said cartons in succession at a relatively slow flow rate sufficient to allow further orientation of the stips during filling of the cartons.

27. The carton filling system of claim 21 wherein said carton conveyor includes a filling stage in association with said guide ramp for filling of the cartons with the product strips, and an overfill removal stage subsequent to said filling stage, said overfill removal stage including means for laterally reciprocating the cartons at a rate and displacement sufficient to throw product strips overfilling the cartons in a lateral direction from the cartons.

28. The carton filling system of claim 27 wherein each of the cartons includes a pair of side flaps and a pair of end flaps at its upper extent for use in closing the carton, said side flaps extending longitudinally in parallel with said first path; and wherein said carton conveyor includes means along said filling stage for positioning each of said side flaps in an angularly upwardly and laterally outwardly projecting position.

29. The carton filling system of claim 28 wherein said carton conveyor further includes a transition stage between said filling stage and said overfill removal stage, said transition stage including means for moving each of said side flaps to a downwardly projecting position alongside the carton.

30. A carton filling system for filling cartons with a plurality of relatively small product strips such as potato strips and the like, comprising:

a carton conveyor for conveying in continuous succession along a first path and at a relatively slow flow rate a plurality of upwardly open cartons having an elongated dimension in alignment with the direction of movement of the cartons;

a product conveyor for conveying a plurality of the product strips along a second path disposed at a relatively small angle with respect to said first path, said product conveyor including a trough having a substantial width for intersection with said carton conveyor over a substantial portion of the length of said carton conveyor for association simultaneously with a plurality of the cartons conveyed along said first path, said trough including a plurality of longitudinally extending risers spaced laterally from each other to define a plurality of longitudinally extending lanes, said lanes each being sized to cause the substantial majority of the product strips to orient longitudinally in alignment with the longitudinal direction of said lanes and in a common plane spread substantially uniformly across the width of said trough; and a guide ramp extending the width of said product conveyor and generally in parallel with said carton conveyor, and defining a downwardly and laterally directed planar surface for guiding the product strips from said product conveyor into the cartons as a substantially oriented plurality of strips in a common plane.

31. The carton filling system of claim 30 wherein the product strips are continuously supplied to said trough at a mass flow rate whereby the substantial majority of the product strips orient in a common plane to extend in alignment with the longitudinal direction of said lanes.

32. The carton filling system of claim 30 wherein said guide ramp extends from said product conveyor to a position generally above one side of the cartons, and wherein said carton conveyor includes a generally vertical deflector wall positioned generally above the side of the cartons opposite said guide ramp.

33. A carton filling system for filling cartons with a plurality of relatively small product strips such as potato strips and the like, comprising:

a carton conveyor for conveying in continuous succession along a first path and at a relatively slow flow rate a plurality of upwardly open cartons having an elongated dimension in alignment with the direction of movement of the cartons, said carton conveyor having a filling stage and an overfill removal stage each for accommodating a plurality of the cartons;

a product conveyor for conveying a plurality of the product strips along a second path for intersection with said first path and disposed at a relatively small angle with respect to said first path, said product conveyor having a substantial width and being disposed for intersection with said first path throughout said filling stage, said product conveyor including means for orienting the substantial majority of the product strips in a common plane spread substantially uniformly across the width of said product conveyor and extending longitudinally generally along said second path;

a guide ramp extending the width of said product conveyor and in parallel with said carton conveyor, and defining a downwardly and laterally directed planar surface terminating generally above one side of the cartons for guiding the product strips from said product conveyor into the cartons as a substantially oriented plurality of strips in a common plane;

a vertically extending deflector wall positioned generally above the side of the cartons opposite said guide ramp;

means for imparting vibratory motion to said carton conveyor for vibrating the cartons throughout said filling stage;

means for laterally reciprocating the cartons throughout said overfill removal stage; and means for collecting the product strips failing to fall into the cartons along said filling stage and the product strips removed from the cartons along said overfill removal stage.

34. A method of filling cartons with a plurality of relatively small product strips, comprising the steps of:

conveying a plurality of upwardly open cartons in succession along a first path;

conveying a plurality of the product strips along a second path for intersection with the first path;

forming the plurality of product strips into substantially a common plane during movement along the second path;

orienting a majority of the product strips to extend substantially in longitudinal alignment with the second path during movement along the second path; and continuously guiding the oriented product strips in the common plane angularly downwardly and laterally over a guide ramp into the cartons conveyed along the first path.

35. The method of claim 34 wherein said steps of conveying, forming, and orienting the product strips comprises supplying the strips continuously to the upper end of a downwardly inclined trough having a plurality of longitudinally extending risers spaced laterally from each other to define longitudinally extending lanes, and vibrating the trough to cause the strips to move continuously along the lanes to spread the strips substantially uniformly into a monolayer across the width of the trough and to cause the substantial majority of the strips to orient in longitudinal alignment with the lanes.

36. The method of claim 35 including the step of supplying the product strips to the trough at a flow rate sufficient to allow the product strips to insure orientation of the strips within the lanes substantially in a common plane.

37. The method of claim 34 wherein said step of conveying the product strips comprises conveying the strips along the second path having a substantial width and at a relatively small angle with respect to the first path for intersection with the first path along a substantial portion of the length of the first path.

38. The method of claim 34 including the step of vibrating the cartons simultaneously with filling of the cartons with the product strips.

39. The method of claim 38 wherein said step of conveying the cartons comprises conveying the cartons at a relatively slow flow rate for relatively slow filling of the cartons with the product strips.

40. The method of claim 34 wherein said step of continuously guiding the strips over the guide ramp comprises positioning the guide ramp generally above one side of the cartons, and including the step of deflecting strips falling over the guide ramp downwardly into the cartons with a vertical deflector wall positioned generally above the opposite side of the cartons.

41. The method of claim 40 including the step of adjustably positioning the deflector wall toward and away from the guide ramp.

42. The method of claim 34 including the step of laterally reciprocating the cartons subsequent to filling of the cartons with the product strips to throw off in a lateral direction any product strips overfilling the cartons.

43. The method of claim 42 wherein each of the cartons includes a pair of side flaps and a pair of end flaps at its upper extent for use in closing the carton, said side flaps extending longitudinally in parallel with the first path, and including the steps of retaining the side flaps each in an upwardly and laterally outwardly projecting direction during filling of the cartons, and moving the side flaps to a downwardly angled direction for said reciprocating step.

44. The method of claim 42 including the step of collecting product strips thrown from the cartons during said reciprocating step.

45. A method of filling cartons with a plurality of potato product strips or the like, comprising the steps of:

conveying a plurality of upwardly open cartons in succession along a first path;

conveying a plurality of the product strips along a second path having a substantial width and at a relatively small angle with respect to the first path for intersection with the first path over a substantial portion of the length of the first path for simultaneous association with a plurality of the cartons;

forming the plurality of product strips into substantially a common plane during movement along the second path;

orienting the plurality of product strips to extend substantially in longitudinal alignment with the second path during movement along the second path;

continuously guiding the oriented product strips in the common plane angularly downwardly and laterally over a guide ramp above one side of the cartons to cause the strips to fall into the cartons conveyed along the first path;

deflecting the falling strips downwardly into the cartons with a deflector wall positioned generally above the opposite side of the cartons; and vibrating the cartons simultaneously with filling of the cartons with the product strips.

46. The method of claim 45 including the step of laterally reciprocating the cartons subsequent to filling of the cartons with the product strips to throw off in a lateral direction any product strips overfilling the cartons.

47. The method of claim 46 wherein said step of conveying the cartons comprises conveying the cartons at a relatively slow flow rate for relatively slow filling of the cartons with the product strips.

48. The method of claim 46 wherein each of the cartons includes a pair of side flaps and a pair of end flaps at its upper extent for use in closing the carton, said side flaps extending longitudinally in parallel with the first path, and including the steps of retaining the side flaps each in an upwardly and laterally outwardly projecting direction during filling of the cartons, and moving the side flaps to a downwardly angled direction for said reciprocating step.

49. A method of filling cartons with a plurality of relatively small product strips such as potato strips and the like, comprising the steps of:

conveying a plurality of upwardly open cartons in succession along a first path at a relatively slow flow rate;

conveying a plurality of the product strips along a second path having a substantial width at a relatively small angle with respect to the first path for intersection with the first path over a substantial portion of the length of the first portion for simultaneous association with a plurality of the cartons;

forming the plurality of product strips into substantially a common plane during movement along the second path;

orienting the plurality of product strips to extend substantially in longitudinal alignment with the second path during movement along the second path;

continuously guiding the oriented product strips in the common plane angularly downwardly and laterally over a guide ramp into the cartons conveyed along the first path; and laterally reciprocating the cartons subsequent to filling of the cartons with the product strips to throw off in a lateral direction any product strips overfilling the cartons.

* * * * *